US009030396B2

(12) United States Patent
Pai et al.

(10) Patent No.: US 9,030,396 B2
(45) Date of Patent: May 12, 2015

(54) LIQUID DISPLAY PANEL DRIVING METHOD

(75) Inventors: Cheng-Chiu Pai, Hsin-Chu (TW); Deniz Yurdasen, Hsin-Chu (TW); Chun-Huai Li, Hsin-Chu (TW); Kung-Yi Chan, Hsin-Chu (TW); Chun-Hung Kuo, Hsin-Chu (TW); Huan-Hsin Li, Hsin-Chu (TW)

(73) Assignee: Au Optronics Corporation, Hsin-Chu (TW)

( * ) Notice: Subject to any disclaimer, the term of this patent is extended or adjusted under 35 U.S.C. 154(b) by 878 days.

(21) Appl. No.: 12/416,318

(22) Filed: Apr. 1, 2009

(65) Prior Publication Data

US 2010/0164850 A1 Jul. 1, 2010

(30) Foreign Application Priority Data

Dec. 26, 2008 (TW) ..... 97150954 A

(51) Int. Cl.
*G09G 3/36* (2006.01)

(52) U.S. Cl.
CPC ..... *G09G 3/3648* (2013.01); *G09G 3/3614* (2013.01); *G09G 2300/0876* (2013.01); *G09G 2310/0251* (2013.01); *G09G 2330/021* (2013.01)

(58) Field of Classification Search
CPC ..... G09G 3/36
USPC ..... 345/94
See application file for complete search history.

(56) References Cited

U.S. PATENT DOCUMENTS 5,151,805 A 9/1992 Takeda et al.
5,202,676 A 4/1993 Yamazaki
5,818,402 A 10/1998 Park et al.
2002/0154084 A1* 10/2002 Tanaka et al. ..... 345/92
2006/0097981 A1* 5/2006 Park et al. ..... 345/102
2006/0256069 A1* 11/2006 Okazaki ..... 345/102
2006/0284815 A1* 12/2006 Kwon et al. ..... 345/98
2007/0146280 A1* 6/2007 Wang ..... 345/94
2009/0002351 A1* 1/2009 Kim ..... 345/204

FOREIGN PATENT DOCUMENTS

JP 2008216937 A * 9/2008
TW 2008-32318 8/2008

OTHER PUBLICATIONS

English language translation of abstract of 2008-32318.
Listing of pertinent part of US Patent No. 5,151,805 (as cited in a Taiwan Office Action dated Apr. 15, 2013).

* cited by examiner

*Primary Examiner* — Kathy Wang-Hurst
*Assistant Examiner* — Jose Soto Lopez
(74) *Attorney, Agent, or Firm* — McClure, Qualey & Rodack, LLP

(57) ABSTRACT

A liquid display panel driving method to drive a plurality of pixels of a liquid display panel in a frame period comprising a plurality of data input intervals is provided. Each pixel comprises first and second capacitors coupled to a first and second common electrode respectively. The liquid display panel driving method comprises the steps of: keeping the second common electrode at the same voltage level; modifying the voltage of the first common electrode of each pixel along a row of scan line to perform a first pre-charge before the data input interval; turning on the pixels to make each pixel receive the data voltage from the data lines during the data input interval; and turning off the pixels and modifying the voltage of the first common electrode to further set the voltage of each of the pixels to a target level after the data input interval.

18 Claims, 9 Drawing Sheets

LIQUID DISPLAY PANEL DRIVING METHOD

RELATED APPLICATIONS

This application claims priority to Taiwan Application Serial Number 97150954, filed Dec. 26, 2008, which is herein incorporated by reference.

BACKGROUND

1. Field of Invention

The present invention relates to a liquid display panel driving method. More particularly, the present invention relates to a liquid display panel driving method to drive a plurality of pixels of a liquid display panel driver circuit in a frame period.

2. Description of Related Art

Liquid crystal display (LCD) is the most important photoelectric industry over these years. It is a well known fact that an LCD that displays a fixed pattern during a long period of time, e.g. a display that spends long periods in standby mode (such as a phone display), will suffer from image retention, i.e. the standby image will appear as a ghost image when the display is switched into active mode, and a new screen is displayed. Thus, the polarity of the voltage of each pixel is inverted for each frame in order to prevent the image retention. The liquid crystal display driving circuit has to continuously charge and discharge the pixel to provide the correct data voltage to each pixel with the correct polarity. Therefore, the speed of the charging and discharging activities determines the speed of the polarity-switching activity, and the voltage target level of the charging and discharging activities determines the power the polarity-switching activity dissipates.

Accordingly, what is needed is a liquid display panel driving method to perform fast polarity-switching activity with lower power dissipation. The present invention addresses such a need.

SUMMARY

A liquid display panel driving method is provided. The liquid display panel driving method is to drive a plurality of pixels of a liquid display panel driver circuit in a frame period, wherein each of the plurality of pixels are placed at the intersections of plurality columns of data lines and plurality rows of scan lines, the frame period comprises a plurality of data input intervals each corresponding to a scan line, each pixel further comprises first and second capacitors coupled to a first and second common electrode respectively, the first common electrode of each pixel is independent, and the second common electrode of each pixel receives the same voltage, the liquid display panel driving method comprises the steps of: keeping the second common electrodes at the same voltage level; modifying the voltage of the first common electrode of each pixel along a row of scan line to perform a first pre-charge before the data input interval corresponding to the row of the scan line; turning on the pixels on the scan line to make each pixel receive the data voltage from the corresponding data lines during the data input interval; and turning off the pixels on the scan line and modifying the voltage of the first common electrode of each pixel to further set the voltage of each of the pixels to a target level after the data input interval.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiments, with reference made to the accompanying drawings as follows:

FIG. 1 is a diagram of the liquid crystal display that the liquid display panel driving method of an embodiment of the present invention is adapted to;

FIG. 5A is a diagram of the liquid crystal display that the liquid display panel driving method of yet another embodiment of the present invention is adapted to;

DETAILED DESCRIPTION

Figure 1:
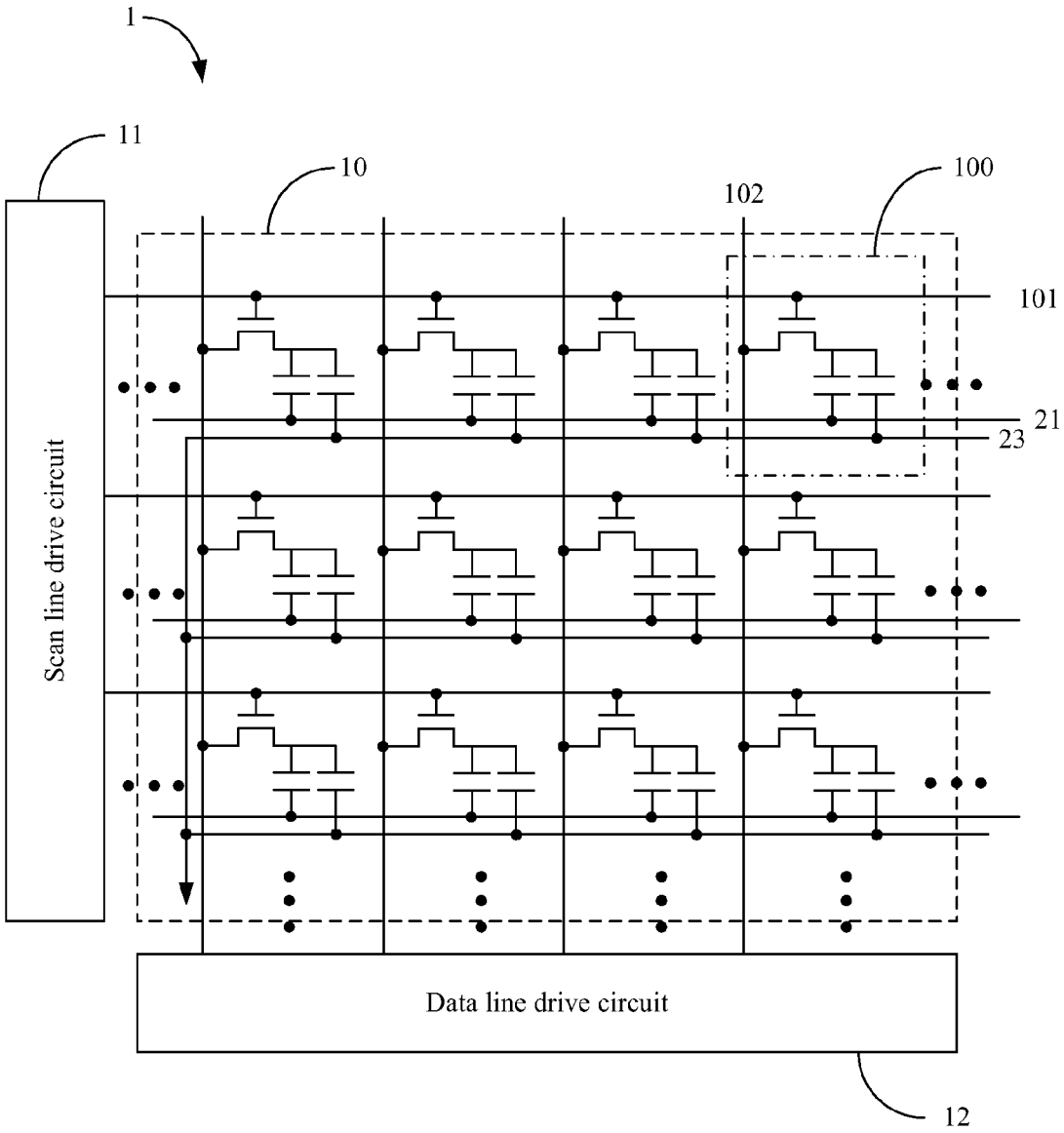

Reference will now be made in detail to the present embodiments of the invention, examples of which are illustrated in the accompanying drawings. Wherever possible, the same reference numbers are used in the drawings and the description to refer to the same or like parts.

Figure 2:
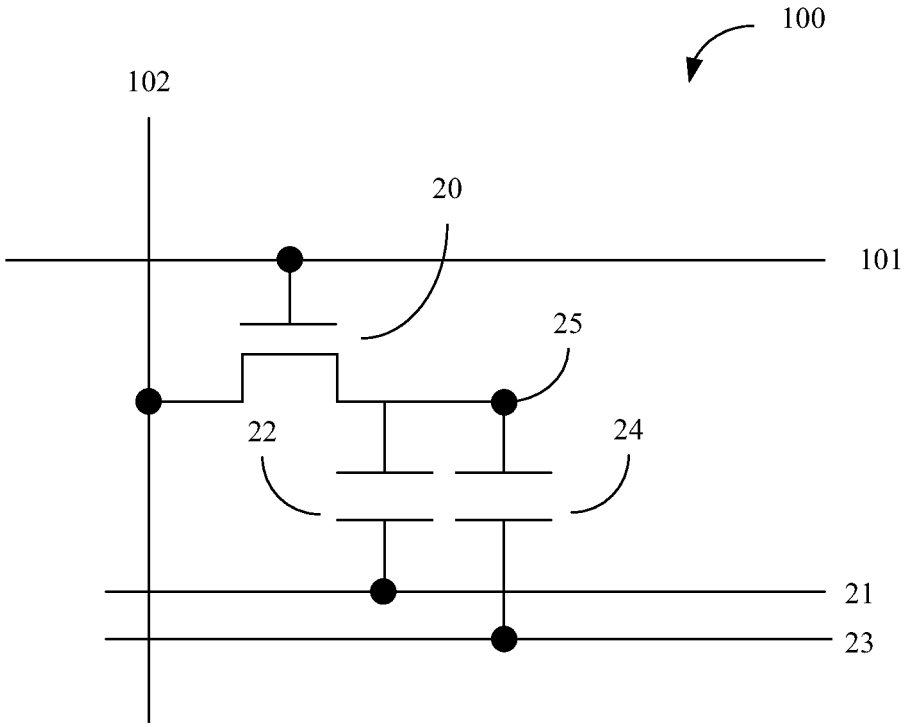
FIG. 2 is a diagram of the pixel of an embodiment of the present invention.

Please refer to FIG. 1. FIG. 1 is a diagram of the liquid crystal display 1 that the liquid display panel driving method of an embodiment of the present invention is adapted to. The liquid crystal display 1 comprises a pixel array 10, a scan line drive circuit 11 and a data line drive circuit 12. The pixel array 10 comprises a plurality of pixels 100, plurality rows of scan lines 101 and plurality columns of data lines 102. Please refer to FIG. 2 at the same time. FIG. 2 is a diagram of the pixel 100 of an embodiment of the present invention. The pixel 100 is placed at the intersection of a data line 102 and a scan line 101. The pixel 100 comprises a transistor 20, a first and second capacitors 22 and 24. The first and second capacitors 22 and 24 are coupled to a first and second common electrode 21 and 23 respectively. The first common electrodes 21 of the pixels 100 on a scan line 101 are connected together, but the first common electrodes 21 corresponding to each row of pixels 100 are independent to each other. The second common electrode 23 of each pixel 100 is connected together to receive the same voltage. A row of pixels 100 are turned on by the signal transmitted by each scan line 101 during a data input interval, and each data line 102 receives a data voltage from the data line drive circuit 12 and further sends the data voltage to a pixel during the data input interval. The data voltage makes the voltage on the point 25 of a pixel 100 shift to an appropriate pixel value. The liquid crystal display shows the image according to all of the pixel values of the pixel array.

Figure 3A:
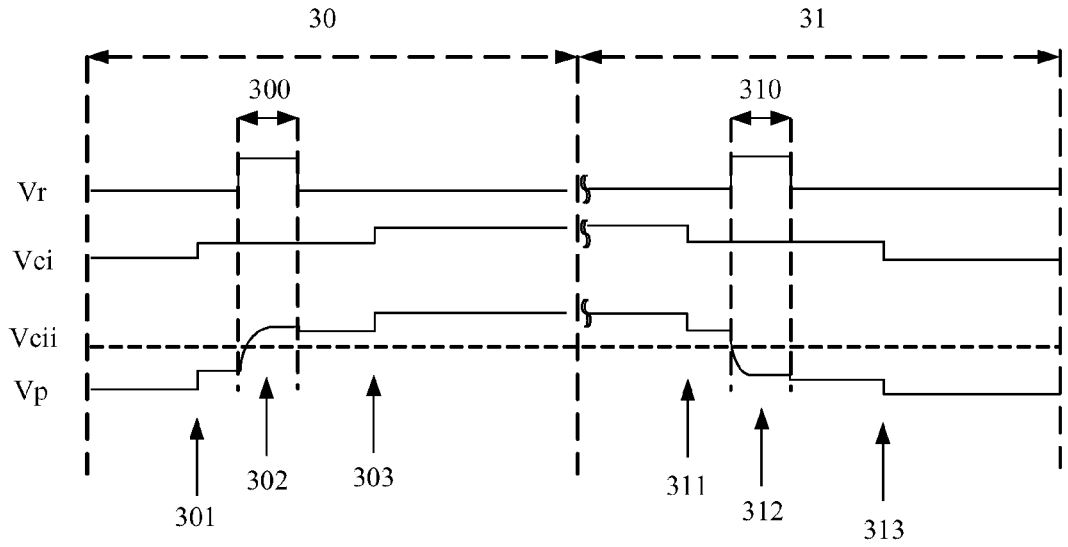
FIG. 3A is a timing diagram depicting the voltage change of a pixel on a row of scan line in two neighboring frame periods in an embodiment of the present invention.
Figure 3B:
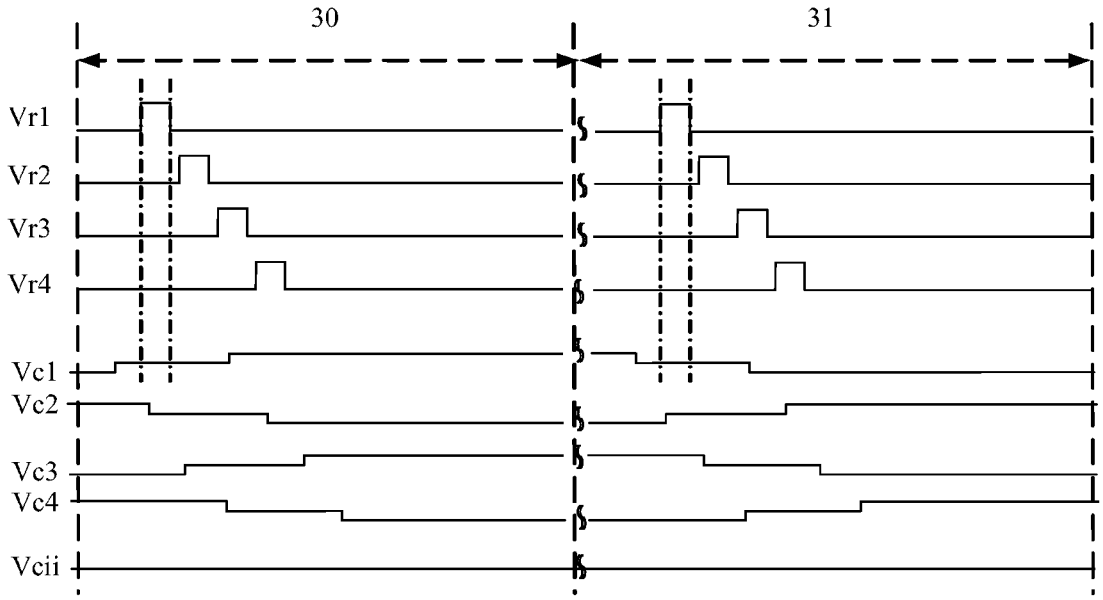
FIG. 3B is a timing diagram depicting the voltage changes of pixels on four neighboring rows of scan lines in two neighboring frame periods in an embodiment of the present invention.

Please refer to FIG. 3A and FIG. 3B. FIG. 3A is a timing diagram depicting the voltage change of a pixel on a row of scan line in two neighboring frame periods in the present embodiment. FIG. 3B is a timing diagram depicting the voltage changes of pixels on four neighboring rows of scan lines in two neighboring frame periods in the present embodiment. The image the user sees on a display panel is actually formed by a plurality of continuous frames. These frames comprise odd frames and even frames, wherein the odd frames appear in odd frame periods and the even frames appear in even frame periods. The odd frames and the even frames are shown in an interlaced manner. For example, the second frame shows after the first frame, and the third frame shows after the second frame. In the present embodiment, during each frame period, the order to turn on the plurality of row of pixels is the same sequential order of the arrangement of the scan lines. In another embodiment, the odd rows of pixels turn on first then followed by even rows of pixels. Each of the rows of pixels is turned on during a corresponding data input interval. Thus, there are numerous data input intervals during each frame period. As shown in FIG. 3B, the data input intervals are not overlapped.

As described above, FIG. 3A is a timing diagram depicting the voltage change of a pixel on a row of scan line in two neighboring frame periods 30 and 31 in the present embodiment. In FIG. 3A, the voltage Vr of the scan line 101, the voltage Vci of the first common electrode 21, the voltage Vcii of the second common electrode 23 and the voltage Vp of the pixel are illustrated. The data input interval 300 and 310 are corresponding to the scan line 101, wherein the data input interval 300 is corresponding to the frame period 30 and the data input interval 310 is corresponding to the frame period 31. The first step of the liquid display panel driving method of the present embodiment is to keep the voltage Vcii of the second common electrode 23 at a DC voltage or said the same voltage level in at least one frame. It is a well-known fact that an LCD that displays a fixed pattern during a long period of time will suffer from image retention. Thus, the polarity of the voltage Vp of each pixel is inverted for each frame in order to prevent the image retention. When the pixel voltage Vp is higher than the voltage Vcii of the second common electrode 23, the polarity of Vp is considered to be a positive polarity. When Vp is lower than the Vcii, the polarity of Vp is considered to be a negative polarity. In the present embodiment, the pixel voltage Vp is negative during the frame period before the frame period 30. During the frame period 30, the row of pixels are not turned on and a modification 301 of the voltage Vci of the first common electrode 21 is generated to perform a first pre-charge 301 before the data input interval 300. In order to turn the voltage Vp from negative polarity to the positive polarity, the modification 301 is a positive value. Then, during the data input interval 300, the pixels 100 on the scan line 101 are turned on to make each pixel 100 receive the data voltage 302 from the corresponding data lines 102. After the data input interval 300, the pixels 100 on the scan line 101 are turned off, and a modification 303 of the voltage Vci of the first common electrode 21 is generated again to further set the voltage Vp of each of the pixels 100 to a target level. The values of the data voltage 302 and the modification 303 are both positive as well to set the final target level of the voltage Vp a positive polarity. The target level is the pixel value of the image shown on the liquid crystal display 1.

The frame period 31 is next to the frame period 30. Therefore, the pixel voltage Vp is going to turn from positive polarity to negative polarity. Please refer to FIG. 3A again. The pixel voltage Vp is positive during the frame period 30 before the frame period 31. During the frame period 31, the row of pixels are not turned on and a modification 311 of the voltage Vci of the first common electrode 21 is generated to perform a first pre-charge 311 before the data input interval 310. In order to turn the voltage Vp from positive polarity to the negative polarity, the modification 311 is a negative value. Then, during the data input interval 310, the pixels 100 on the scan line 101 are turned on to make each pixel 100 receive the data voltage 312 from the corresponding data lines 102. After the data input interval 310, the pixels 100 on the scan line 101 are turned off, and a modification 313 of the voltage Vci of the first common electrode 21 is generated again to further set the voltage Vp of each of the pixels 100 to a target level. The values of the data voltage 312 and the modification 313 are both negative as well to set the final target level of the voltage Vp a negative polarity. The target level is the pixel value of the image shown on the liquid crystal display 1.

FIG. 3B is a timing diagram depicting the voltage changes Vr1, Vr2, Vr3 and Vr4 of four neighboring rows of the scan lines, the voltage changes Vc1, Vc2, Vc3 and Vc4 of the first electrodes of the pixels on four neighboring rows of scan lines and the voltage Vcii of the second common electrode in two neighboring frame periods in the present embodiment. As described above, in the present embodiment, the order to turn on the plurality of row of pixels is the same sequential order of the arrangement of the scan lines 101 during each frame period, the data input intervals of each frame are not overlapped and the polarities of the pixel voltages of two neighboring scan lines 101 are opposite to each other. Therefore, the two neighboring first common electrode has opposite voltage polarities and the polarities of the target level for two neighboring rows of pixels are opposite as well. According to the above characteristic, the liquid crystal display 1 of the present embodiment is a row inversion one.

In the present embodiment, the advantage of the first pre-charge is to make use of the voltage modification of the first common electrode to charge the pixel before the data input interval to make the pixel voltage approach the voltage level of the second common electrode. Thus, the data line driver circuit needs not provide a higher data voltage or provide the data voltage for a long time to make the pixel voltage switch to the opposite polarity. The purpose of the modification of the first common electrode after the data input interval is the same as the modification before the data input interval. Thus, the amount of data voltage dramatically reduces to accomplish a power-saving mechanism.

Figure 3C:
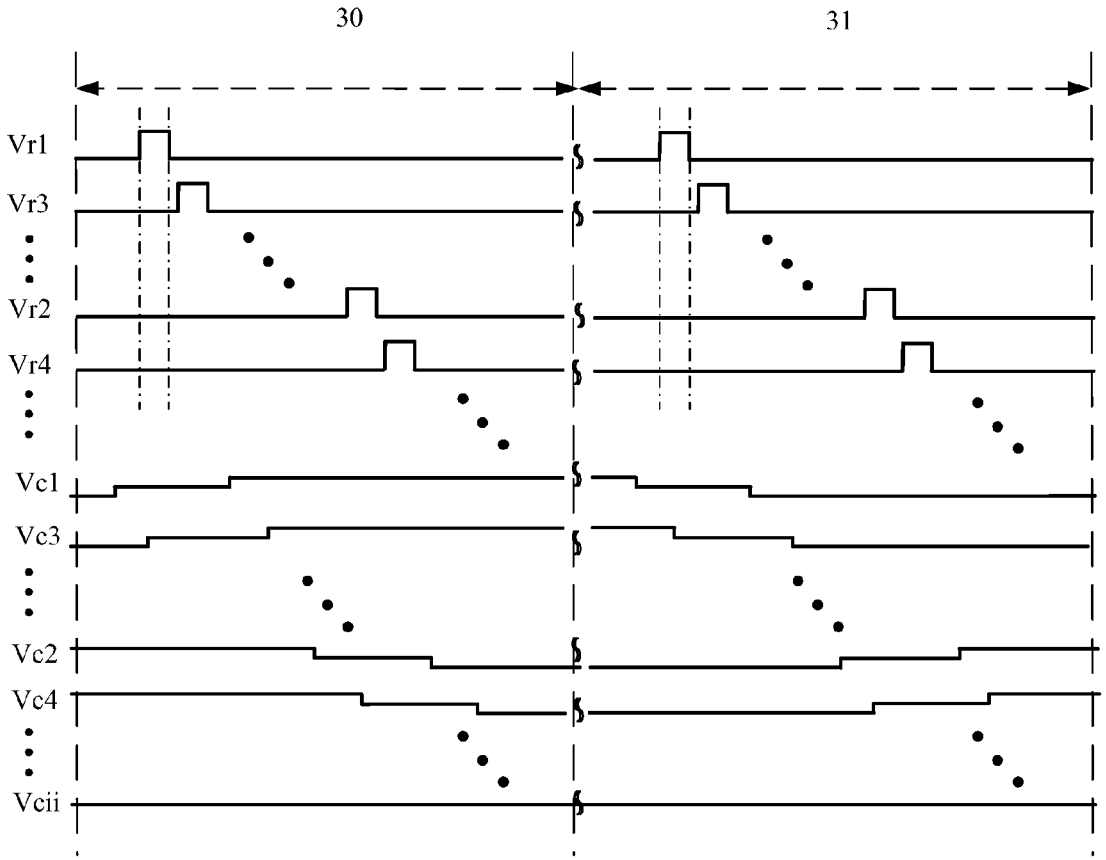
FIG. 3C is a timing diagram depicting the voltage change of a pixel on a row of scan line in two neighboring frame periods with interlaced turn-on order in an embodiment of the present invention.

In another embodiment, the scan lines comprise a plurality of odd scan lines and a plurality of even scan lines. In each frame period, the odd rows of pixels turn on first then followed by even rows of pixels. Please refer to FIG. 3C, wherein the order of the data input intervals corresponding to each scan line is shown, the odd rows 1, 3, 5, . . . of pixels turn on first, then followed by even rows 2, 4, 6, . . . of pixels. Thus, the order of the modification of the pixel voltage is the same as the order of the data input intervals as well.

Figure 4A:
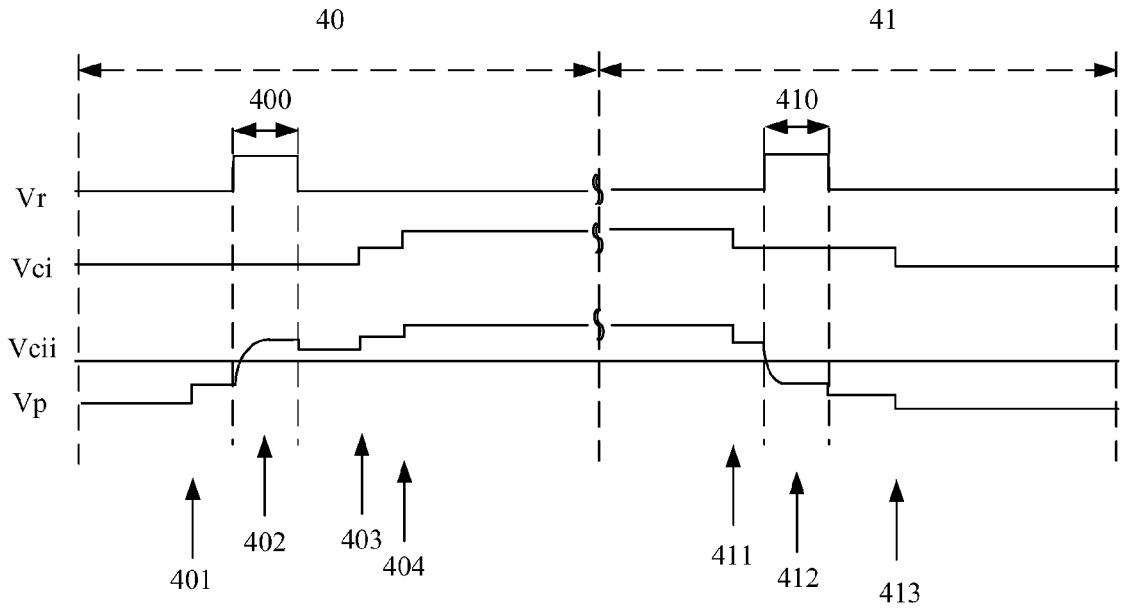
FIG. 4A is a timing diagram depicting the voltage change of a pixel on a row of scan line in two neighboring frame periods in another embodiment of the present invention.
Figure 4B:
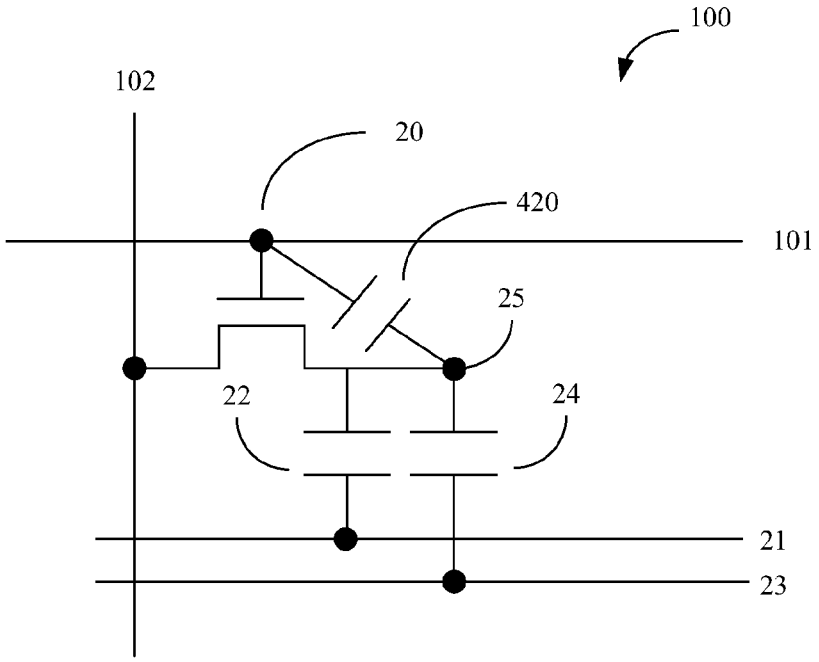
FIG. 4B is a diagram of the pixel of another embodiment of the present invention.
Figure 4C:
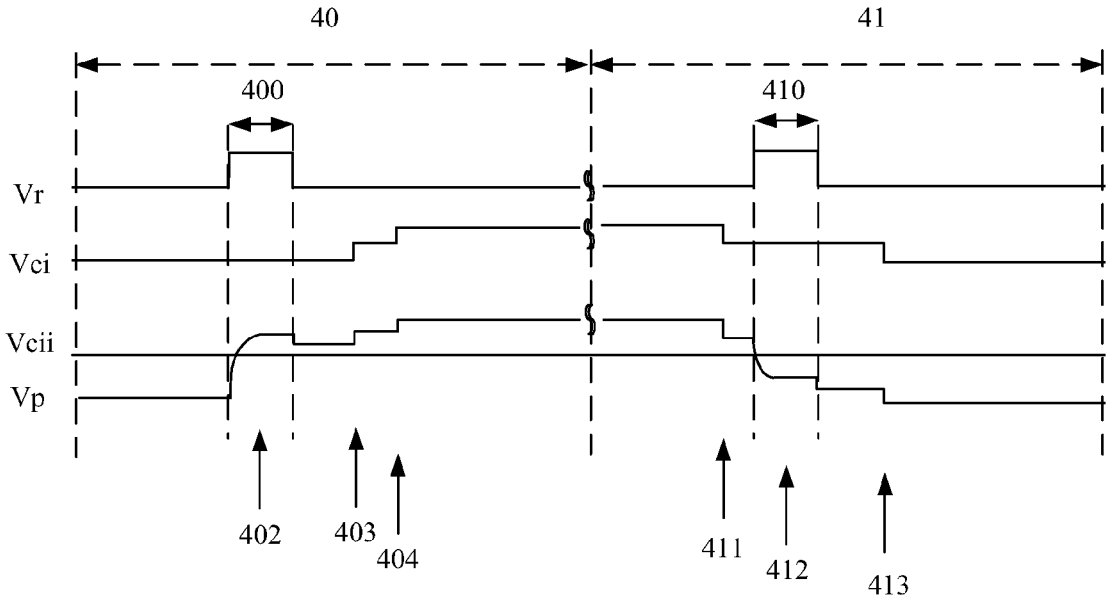
FIG. 4C is a timing diagram depicting the voltage change of a pixel on a row of scan line in two neighboring frame periods without the use of the first pre-charge in another embodiment of the present invention.

Please refer to FIG. 4A. FIG. 4A is a timing diagram depicting the voltage change of a pixel on a row of scan line in two neighboring frame periods 40 and 41 in another embodiment of the present invention. In FIG. 4A, the voltage Vr of the scan line 101, the voltage Vci of the first common electrode 21, the voltage Vcii of the second common electrode 23 and the voltage Vp of the pixel are illustrated. Please refer to FIG. 4B at the same time. FIG. 4B is a diagram of a pixel of the present embodiment of the present invention. There is an effect of parasitic capacitor 420 between the gate of the transistor 20 of the pixel and the first and the second capacitors 22 and 24. The parasitic capacitor 420 is the source of the leakage current. The leakage current degrades the performance of the charging activity during the polarity switching process. Thus, the pixel voltage can't be charged to the target level due to the leakage current. As shown in FIG. 4A, in addition to the first pre-charge 401, the data voltage 402 and the modification 403 as described in the above embodiment, there is a modification 404 of the first common electrode 21 in the present embodiment. The modification 404 is to compensate the effect of the leakage current. Please refer to FIG. 4C. FIG. 4C is a timing diagram depicting the voltage change of a pixel on a row of scan line in two neighboring frame periods 40 and 41 in yet another embodiment of the present invention. It's noticed that in the embodiment as shown in FIG. 4C, the first pre-charge 401 is absent while the two-step modification after the data input interval 400 is present. Thus, in FIG. 4C, there are only the data voltage 402, modification 403 and modification 404. However, the data line drive circuit 12 has to provide the data voltage 402 with higher voltage level to accomplish the switching of the polarity of the pixel voltage Vp in the present embodiment.

Figure 5A:
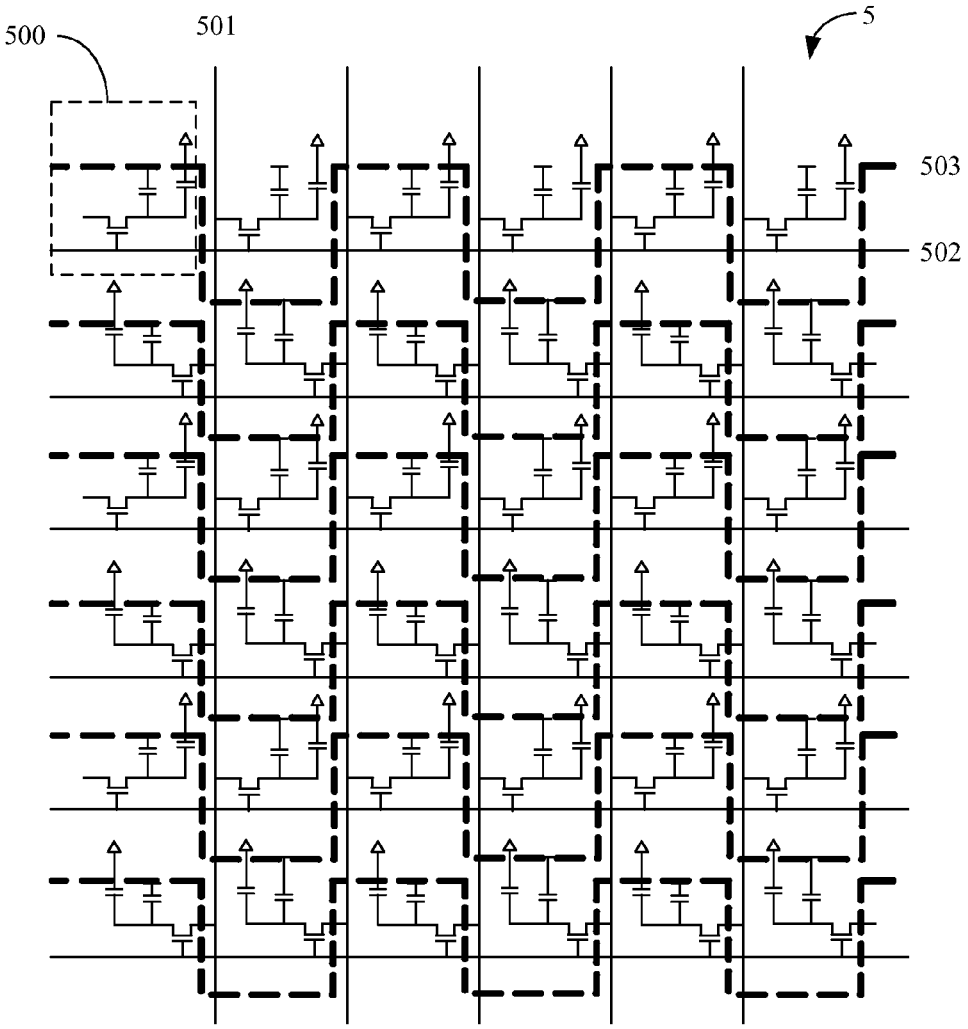
Figure 5B:
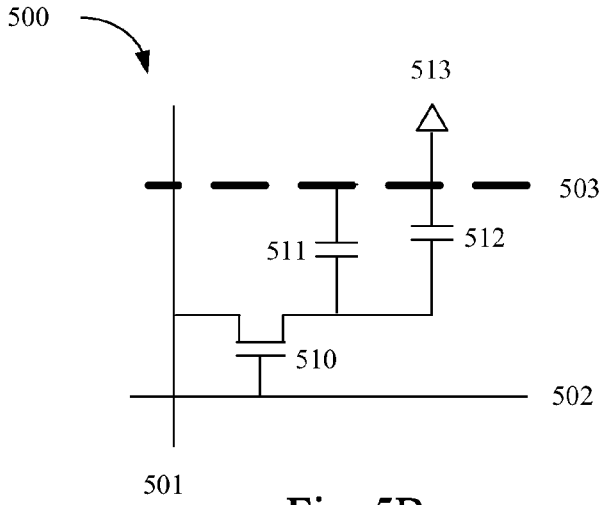
FIG. 5B is a diagram of the pixel of yet another embodiment of the present invention.

Please refer to FIG. 5A. FIG. 5A is a diagram of a pixel array 5 of a liquid crystal array, wherein the liquid display panel driving method of another embodiment of the present invention is adapted to the pixel array 5. The pixel array 5 comprises a plurality of pixels 500, a plurality rows of scan lines 502 and a plurality columns of data lines 501. Please refer to FIG. 5B at the same time. FIG. 5B is a diagram of the pixel 500 of an embodiment of the present invention. The pixel 500 is placed at the intersection of a data line 501 and a scan line 502. The pixel 500 comprises a transistor 50, a first and second capacitors 511 and 512. The first and second capacitors 511 and 512 are coupled to a first and second common electrode 503 and 513 respectively. The second common electrode 513 of each pixel 500 is connected together to receive the same voltage. However, it's noticed that each "row" of the first common electrode 503 is connected in a saw-tooth manner between two neighboring rows of pixels 500, and each "row" of the first common electrode 503 are independent to each other. Thus, with the plurality of rows of the first common electrode 503 connected with an interlaced manner and the plurality of columns of the data lines connected with an interlaced manner, the liquid crystal display becomes a dot inversion one.

Figure 6A:
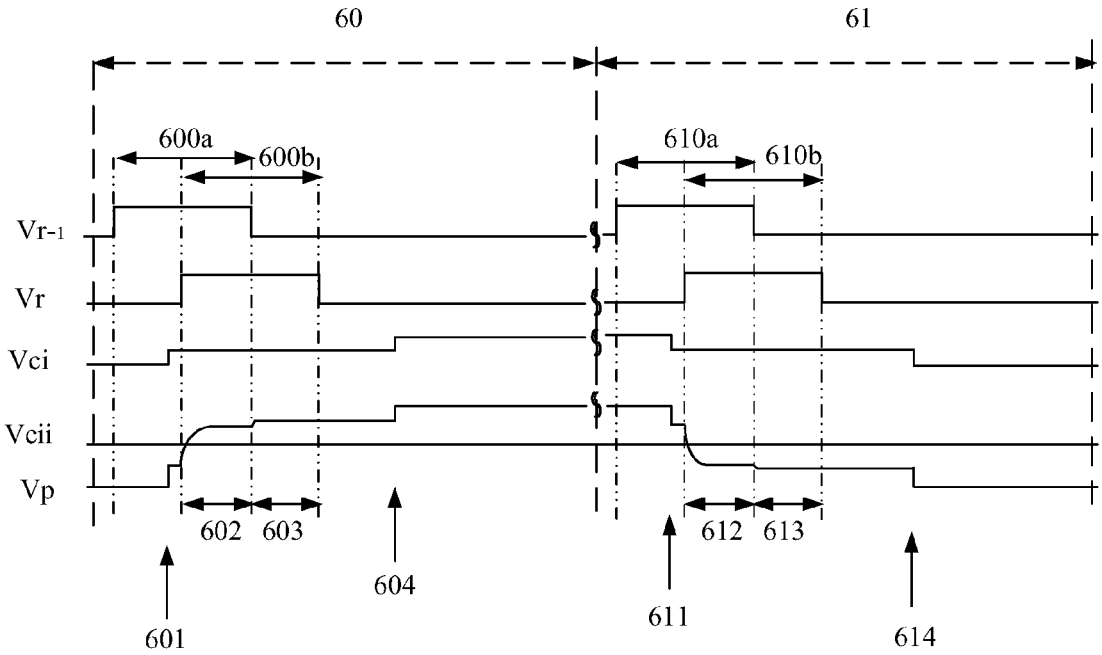
FIG. 6A is a timing diagram depicting the voltage change of a pixel on a row of scan line in two neighboring frame periods in another embodiment of the present invention.
Figure 6B:
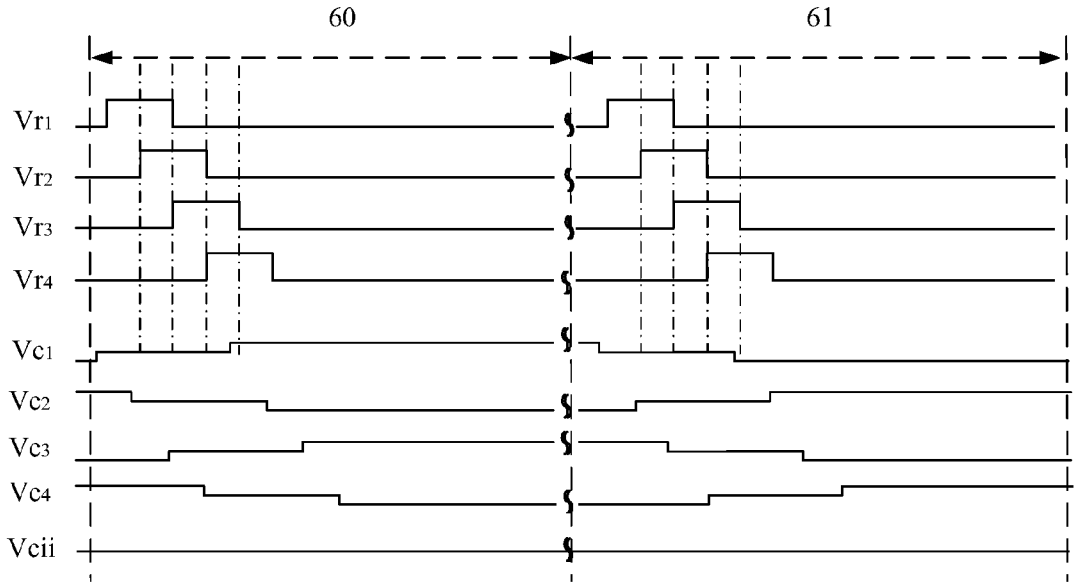
FIG. 6B is a timing diagram depicting the voltage changes of pixels on four neighboring rows of scan lines in two neighboring frame periods in another embodiment of the present invention.

Please refer to FIG. 6A and FIG. 6B. FIG. 6A is a timing diagram depicting the voltage change of a pixel on a row of scan line in two neighboring frame periods 60 and 61 in another embodiment of the present invention. FIG. 6B is a timing diagram depicting the voltage changes Vr1, Vr2, Vr3 and Vr4 of four neighboring rows of the scan lines, the voltage changes Vc1, Vc2, Vc3 and Vc4 of the first electrodes of the pixels on four neighboring rows of scan lines and the voltage Vcii of the second common electrode in two neighboring frame periods in the present embodiment. In the present embodiment, the two neighboring data input interval comprises an overlapped interval. As shown in FIG. 6A, the data input intervals 600*a* and 600*b* are corresponding to two neighboring scan lines with the voltage Vr−1 and Vr. The data input interval 600*b* thus has an overlapped interval 602 and a non-overlapped interval 603. The first step of the liquid display panel driving method of the present embodiment is to keep the voltage Vcii of the second common electrode at the same voltage level. Before the data interval 600*b*, the pixels on the r-th row of scan line are not turned on. A modification 601 of the voltage Vci of the first common electrode 503 is generated to perform a first pre-charge 601 before the data input interval 600*b*. In order to turn the voltage Vp from negative polarity to the positive polarity, the modification 601 is a positive value. During the overlapped interval 602, the pixels on the r−1-th and the r-th row are turned on at the same time. The data voltage is substantially sent to both the pixels on the r−1-th and the r-th row. Thus, for the pixels on the r-th row, the data voltage during the overlapped interval 602 is considered as a second pre-charge. Then during the non-overlapped interval 603, the data voltage is substantially sent to both the pixels on the r-th and the r+1-th row (not shown). Thus, for the pixels on the r-th row, the data voltage during the non-overlapped interval 602 is considered as the supply of the data voltage. After the data input interval 600*b*, the row of the pixels are turned off, and a modification 604 of the common electrode is generated to further set the voltage Vp of each of the pixels to the target level. The values of the modification 611, the second pre-charge, the data voltage and the modification 604 are both positive as well to set the final target level of the voltage Vp a positive polarity. The target level is the pixel value of the image shown on the liquid crystal display. The process during the frame period 61 is similar to the process during the frame period 60 but with the opposite polarity.

Figure 6C:
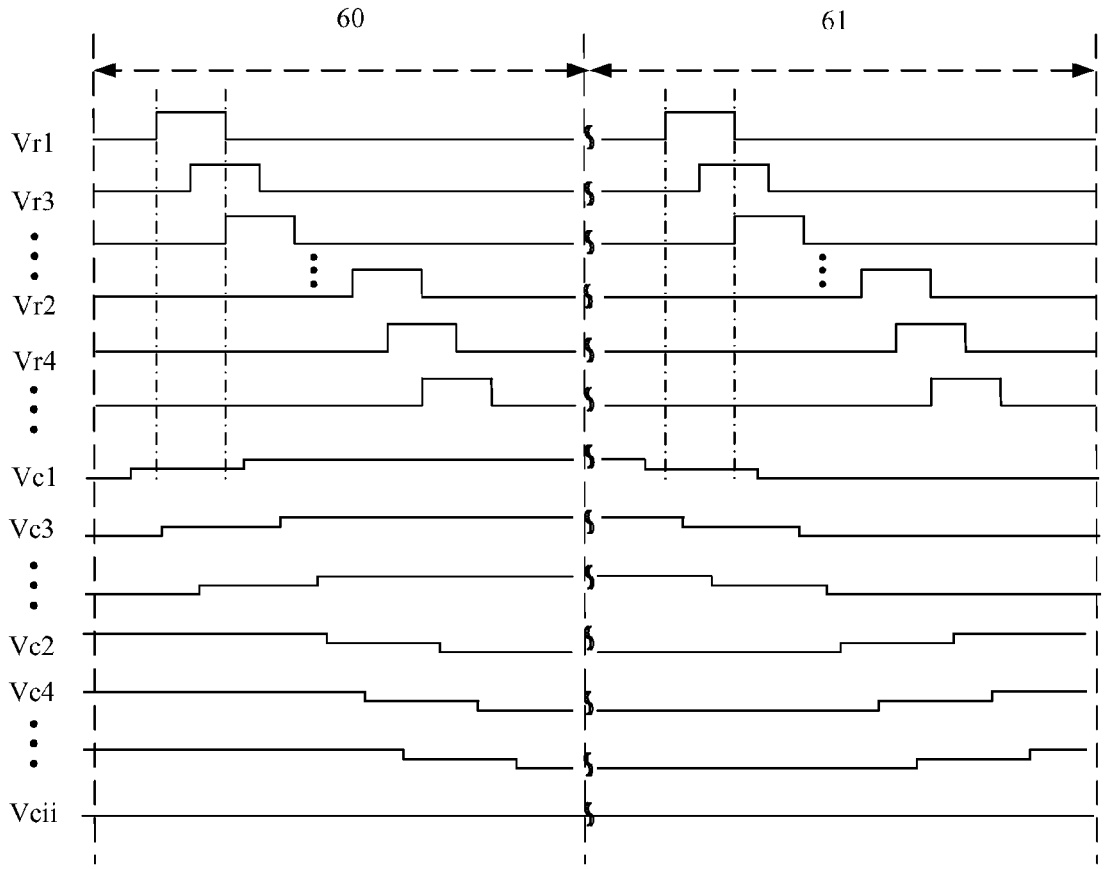
FIG. 6C is a timing diagram depicting the voltage change of a pixel on a row of scan line in two neighboring frame periods with interlaced turn-on order in an embodiment of the present invention.

FIG. 6B, as described above, is a timing diagram depicting the voltage changes Vr1, Vr2, Vr3 and Vr4 of four neighboring rows of the scan lines, the voltage changes Vc1, Vc2, Vc3 and Vc4 of the first electrodes of the pixels on four neighboring rows of scan lines and the voltage Vcii of the second common electrode in two neighboring frame periods in the present embodiment. The second capacitors of all the pixels on a scan line are connected to the same second common electrode with a steady voltage Vcii in the present embodiment. In another embodiment, the scan lines can further comprise a plurality of odd scan lines and a plurality of even scan lines. Besides the sequential order, the odd rows of pixels can be turned on first then followed by even rows of pixels, as depicted in FIG. 6C.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A liquid display panel driving method to drive a plurality of pixels of a liquid display panel in a frame period, wherein each of the plurality of pixels are placed at the intersections of a plurality columns of data lines and a plurality rows of scan lines, the frame period comprises a plurality of data input intervals each corresponding to a scan line, each pixel further comprises first and second capacitors coupled to a first and second common electrode respectively, the first common electrodes of each row of pixels are independent, and the second common electrode of each pixel receives the same voltage, the liquid display panel driving method comprises the steps of:

keeping the second common electrodes at the same voltage level;

modifying the voltage of the first common electrode of each pixel along a row of scan line to perform a first pre-charge before the data input interval corresponding to the row of the scan line;

turning on the pixels on the scan line to make each pixel receive the data voltage from the corresponding data lines during the data input interval; and turning off the pixels on the scan line and modifying the voltage of the first common electrode of each pixel to further set the voltage of each of the pixels to a target level after the data input interval, wherein the voltage of the first common electrode being elevated at least two times or decreased at least two times corresponding to each of the data input intervals, and the scan line being enabled once during each of the data input intervals;

wherein when the target level of a frame period is a positive level, the voltage modification of the first common electrode after the data input interval and before the next data input interval of the scan line substantially comprises two modifying steps to set the voltage of each of the pixels to the target level.

2. The liquid display panel driving method of claim 1, wherein the voltage of each of the pixels along the scan line has opposite polarity of target levels in two neighboring frame period.

3. The liquid display panel driving method of claim 2, wherein when the target level of a frame period is a positive level, the voltage modification of the first common electrode and the data voltage received are both a positive value, when the target level of a frame period is a negative level, the voltage modification of the first common electrode and the data voltage received are both a negative value.

4. The liquid display panel driving method of claim 1, wherein the liquid display panel is a row inversion liquid display panel.

5. The liquid display panel driving method of claim 1, wherein each of the plurality of the data input intervals is separated from each other.

6. The liquid display panel driving method of claim 1, wherein the order to turn on the plurality of row of pixels is the same sequential order of the arrangement of the scan lines.

7. The liquid display panel driving method of claim 1, wherein the order to turn on the plurality of rows of pixels is to turn on the odd rows of pixels first then followed by even rows of pixels.

8. The liquid display panel driving method of claim 1, wherein when the target level of one of the pixel is a positive level, the voltage modification of the first pre-charge and the data voltage received by the pixel are both a positive value, when the target level of the pixel is a negative level, the voltage modification of the first pre-charge and the data voltage received by the pixel are both a negative value.

9. A liquid display panel driving method to drive a plurality of pixels of a liquid display panel in a frame period, wherein each of the plurality of pixels are placed at the intersections of a plurality columns of data lines and a plurality rows of scan lines, the frame period comprises a plurality of data input intervals each corresponding to a scan line, each pixel further comprises first and second capacitors, whose first ends are coupled to a first and second common electrode respectively, the first common electrodes of each row of pixels are independent, the second common electrode of each pixel receives the same voltage, and second ends of the first capacitors and the second capacitors are coupled to the data lines through transistors, the liquid display panel driving method comprises the steps of:

keeping the second common electrodes at the same voltage level;

modifying the voltage of the first common electrode of each pixel along a row of scan line to perform a first pre-charge to elevate or decreased the voltage of each of the pixels from a first voltage level to a second voltage level before the data input interval corresponding to the row of the scan line, wherein the voltage of each of the pixels is a voltage on the second ends of the first and second capacitor;

turning on the pixels on the scan line to make each pixel receive the data voltage from the corresponding data lines during the data input interval; and turning off the pixels on the scan line and modifying the voltage of the first common electrode of each pixel to further set the voltage of each of the pixels to a target level after the data input interval, wherein the voltage of the first common electrode being elevated at least two times or decreased at least two times corresponding to each of the data input intervals, and the scan line being enabled once during each of the data input intervals.

10. The liquid display panel driving method of claim 9, wherein the voltage of each of the pixels along the scan line has opposite polarity of target levels in two neighboring frame period.

11. The liquid display panel driving method of claim 10, wherein when the target level of a frame period is a positive level, the voltage modification of the first common electrode and the data voltage received are both a positive value, when the target level of a frame period is a negative level, the voltage modification of the first common electrode and the data voltage received are both a negative value.

12. The liquid display panel driving method of claim 11, wherein when the target level of a frame period is a positive level, the voltage modification of the first common electrode after the data input interval substantially comprises two modifying steps to set the voltage of each of the pixels to the target level.

13. The liquid display panel driving method of claim 9, wherein the liquid display panel is a row inversion liquid display panel.

14. The liquid display panel driving method of claim 9, wherein each of the plurality of the data input intervals is separated from each other.

15. The liquid display panel driving method of claim 9, wherein each of the two data input intervals corresponding to two neighboring scan lines have an overlapped interval, the pixels on the latter scan line make use of the pixel voltages of the pixels of the former scan line to perform a second pre-charge during the overlapped interval.

16. The liquid display panel driving method of claim 15, wherein the pixels on the latter scan line receives the data voltage from the corresponding data lines during the data input interval after the overlapped interval.

17. The liquid display panel driving method of claim 9, wherein the order to turn on the plurality of row of pixels is the same sequential order of the arrangement of the scan lines.

18. The liquid display panel driving method of claim 9, wherein when the target level of one of the pixel is a positive level, the second voltage level is elevated from the first voltage level and the data voltage received by the pixel is a positive value, when the target level of the pixel is a negative level, the second voltage level is decreased from the first voltage level and the data voltage received by the pixel is a negative value.

* * * * *